US011322860B2

(12) United States Patent
Stjepanovic et al.

(10) Patent No.: US 11,322,860 B2
(45) Date of Patent: May 3, 2022

(54) CONNECTION DEVICE FOR THE CONNECTION OF A CONDUCTOR END

(71) Applicant: Weidmüller Interface GmbH & Co. KG, Detmold (DE)

(72) Inventors: Karlo Stjepanovic, Bielefeld (DE); Stephan Fehling, Lage (DE); Constantin Classen, Detmold (DE); Marco Waldhoff, Sandebeck (DE)

(73) Assignee: Weidmüller Interface GmbH & Co. KG

( * ) Notice: Subject to any disclaimer, the term of this patent is extended or adjusted under 35 U.S.C. 154(b) by 51 days.

(21) Appl. No.: 16/767,031

(22) PCT Filed: Nov. 21, 2018

(86) PCT No.: PCT/EP2018/082074
§ 371 (c)(1),
(2) Date: Oct. 27, 2020

(87) PCT Pub. No.: WO2019/105824
PCT Pub. Date: Jun. 6, 2019

(65) Prior Publication Data

US 2021/0320436 A1 Oct. 14, 2021

(30) Foreign Application Priority Data

Nov. 28, 2017 (DE) ..... 20 2017 107 208.8

(51) Int. Cl.
*H01R 4/48* (2006.01)
*H01R 11/09* (2006.01)

(52) U.S. Cl.
CPC ..... *H01R 4/4836* (2013.01); *H01R 11/09* (2013.01)

(58) Field of Classification Search
None
See application file for complete search history.

(56) References Cited

FOREIGN PATENT DOCUMENTS

| | | | |
|---|---|---|---|
| CN | 105428914 | A | 3/2016 |
| DE | 69703829 | T2 | 7/2001 |
| DE | 20312123 | U1 | 10/2003 |
| DE | 1020060181157 | A1 | 11/2007 |
| DE | 202011051516 | U1 | 1/2013 |
| DE | 102012011794 | A1 | 12/2013 |
| DE | 10201400354 | A1 | 7/2015 |
| EP | 3041089 | A1 | 7/2016 |
| WO | 2013185893 | A1 | 12/2013 |

*Primary Examiner* — Ross N Gushi
(74) *Attorney, Agent, or Firm* — Laubscher & Laubscher, P.C.

(57) ABSTRACT

A connection device for the connection of a conductor end includes a housing having a slotted link, a busbar section having a slotted link aligned with the housing slotted link, an d clamping spring assembly rotatably connected with the housing and operable between an open position and a contact position with the conductor end. A rotary lever assembly including a rotary lever element is operably connected with the clamping spring assembly. The rotary lever element has a cam section and a control curve section on which the clamping spring assembly slides during movement into the contact position. A clamping device is arranged on the cam section and is retained by the housing and busbar slotted links.

17 Claims, 15 Drawing Sheets

CONNECTION DEVICE FOR THE CONNECTION OF A CONDUCTOR END

This application is a § 371 National Stage Entry of International Patent Application No. PCT/EP2018/082074 filed Nov. 21, 2018. Application No. PCT/EP2018/082074 claims priority of DE 20 2017 107 208.8 filed Nov. 28, 2017. The entire content of these applications is incorporated herein by reference.

BACKGROUND OF THE INVENTION

The invention relates to a connection device for the connection of a conductor end.

Connection devices of this type are known in the art. However, with regard to the handling and structural design of the known connection devices, they are only able to be actuated with difficulty, specifically when contacting conductors of larger diameter, and therefore require improvement.

Against this background, the object of the invention is to provide a connection device which is improved in terms of the handling and structural design thereof.

SUMMARY OF THE INVENTION

The invention provides a connection device for the connection of a conductor end, which connection device has a housing and also a busbar section, a clamping spring assembly and a rotary lever assembly in the housing. The clamping spring assembly can be rotated, with the aid of the rotary lever assembly, from an open position to a contact position in which contact is made with the conductor end. In this case, the rotary lever assembly has a rotary lever element which is rotatably mounted in the housing preferably in or on a central section, wherein the rotary lever element further has a cam section, which has a control curve on which the clamping spring assembly slides along during movement into the end contact position.

In this case, a guiding device of the cam section, such as a projection or a pin or the like inserted into cam section, engages in a slotted link of the housing, and a clamping and/or latching device, which is movable in the slotted link, is formed on the cam section, the slotted link of the housing being aligned with a slotted link in the busbar section in which a fixing position is formed for the clamping and/or latching device.

In this way, both reliable contact of a conductor and reliable release of the conductor from the end contact position can take place in a simple manner.

It is particularly advantageous that the end contact position is durably securely fixed on the metal busbar and not, or not only, in the plastics material housing.

According to a preferred configuration, the guiding device and the clamping and/or latching device may be formed by one and the same element, for example by a pin, in particular a metal pin.

In this context, attaching a pin to the cam section and forming the latching position in the slotted link of the busbar section offers a particularly simple embodiment for implementing the fixing of the spring assembly in the end contact position, which also results in simple and consistent usability when establishing and releasing the contact position.

According to one embodiment the clamping and/or latching device is a pin, in particular a metal pin, which is movable in the slotted link into a fixing position.

In the housing, before the latching position is reached, the slotted link transitions into a corresponding slotted link in the associated busbar section, or rather ends in this section and this slotted link has a point, in particular a constriction point or a top-dead-center point, at which the pin is fixed securely in position when the end contact position is reached, in such a way that the end contact position is durably securely fixed at the metal busbar section. Specifically, for releasing the end contact position, it is merely necessary to move the pin out of the latching position behind the constriction point in the slotted link by rotating the rotary lever assembly.

In this way, when the end contact position is reached, the clamping limb or limbs press on the conductor end, the clamping spring assembly and/or the rotary lever assembly additionally being locked on a thrust bearing in a positive and/or non-positive fit by a locking device.

The spring assembly has one or more clamping springs and one or two clamping limbs press on the conductor end when the end contact position is reached.

According to a preferred embodiment, the rotary lever assembly and the clamping spring assembly may always or at least during the rotation from the open position into the contact position have the same direction of rotation. However, it is also possible for them to have opposite directions of rotation.

If they have the same directions of rotation, this has the particular advantage that it becomes possible to form relatively small actuating forces.

To achieve higher contact forces and lower actuating forces, and a compact, narrow design, the axis of rotation D1 of the clamping spring assembly and sections of the clamping spring assembly are arranged above the conductor end to be contacted and above the associated busbar section, and the rotary lever assembly has an axis of rotation D2 which is positioned above the axis of rotation D1 of the clamping spring assembly.

In a further preferred embodiment, the busbar section may be configured trough-shaped, in particular V- or U-shaped, in cross section, the conductor end being insertable into the busbar section perpendicular to this cross section, and the clamping spring assembly being designed to be pivoted, at least in sections, into the busbar section transverse to the conductor insertion direction so as to press the conductor end in the end contact position into the trough-shaped busbar section so as to contact this section. The invention is particularly well-suited to a structural configuration of this type.

It may further be provided that the rotary lever assembly has a rotary lever element which is rotatably mounted in the housing preferably in or on a central section, and has the axis of rotation D2 and that the rotary lever element has a cam section, which has —preferably on the face thereof facing the clamping spring assembly—a control curve on which the actuating limb or limbs of the clamping springs or a rotary spring carrier/spring holder slide along during a movement into the end contact position.

To ensure a well-guided movement into and out of the end contact position, a projection of the cam section or a pin or the like is inserted into the section and engages in a slotted link of the housing, specifically in an arc-shaped slotted link.

To secure the end contact position, in the end contact position, the clamping spring assembly and/or the actuating limb are additionally fixed, by a locking device, in a positive and/or non-positive fit, for example on the busbar section or on another element.

For this purpose, a clamping and/or latching device, for example the aforementioned pin which is movable into a fixing position in the slotted link, may be formed on the cam section with the fixing position formed in the—preferably metal—busbar section, since in this way a high contact force can also be durably ensured.

The actuating limb or limbs are formed elbowed at the free ends thereof so as to slide on the control curve.

The clamping spring assembly can have a spring carrier. The spring carrier may be formed in one piece with the housing. However, the spring carrier may also—if an actuating limb is arranged rotationally engaged thereon—join in with the functionality of this actuating limb in whole or in part. In this case, the carrier also forms part of the clamping spring assembly.

BRIEF DESCRIPTION OF THE FIGURES

Other objects and advantages of the invention will become apparent from a study of the following description when viewed in the light of the accompanying drawing, in which.

DETAILED DESCRIPTION

Figure 1A:
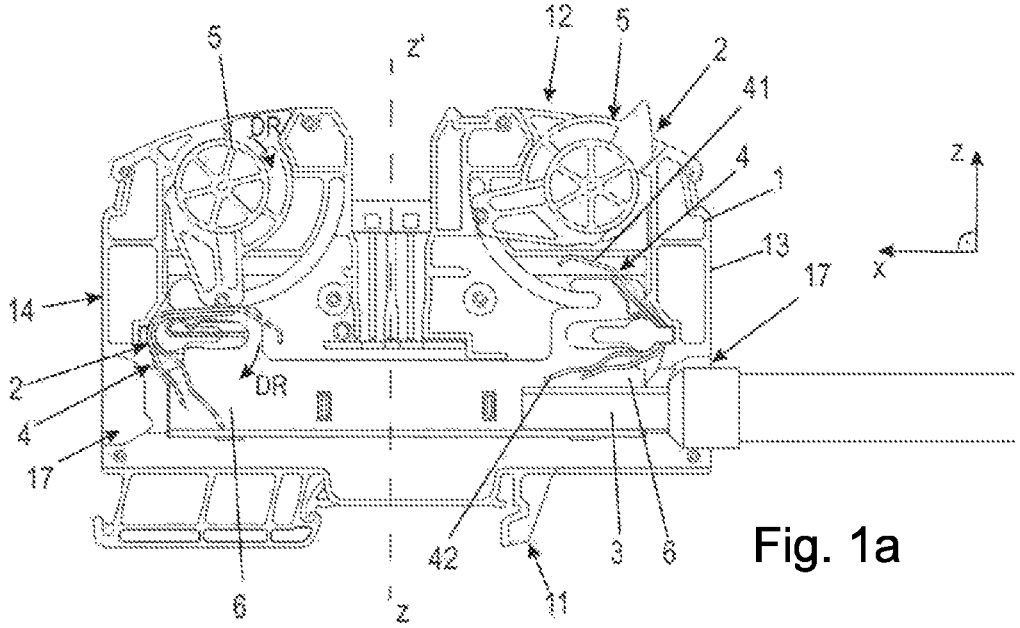
FIG. 1*a* is a sectional view of a series terminal including connection devices according to the invention, of which one is in a first, closed operating position, without a conductor end inserted into it, and of which the other, second connection device is in an open, first operating position upon insertion of the conductor end.
Figure 1B:
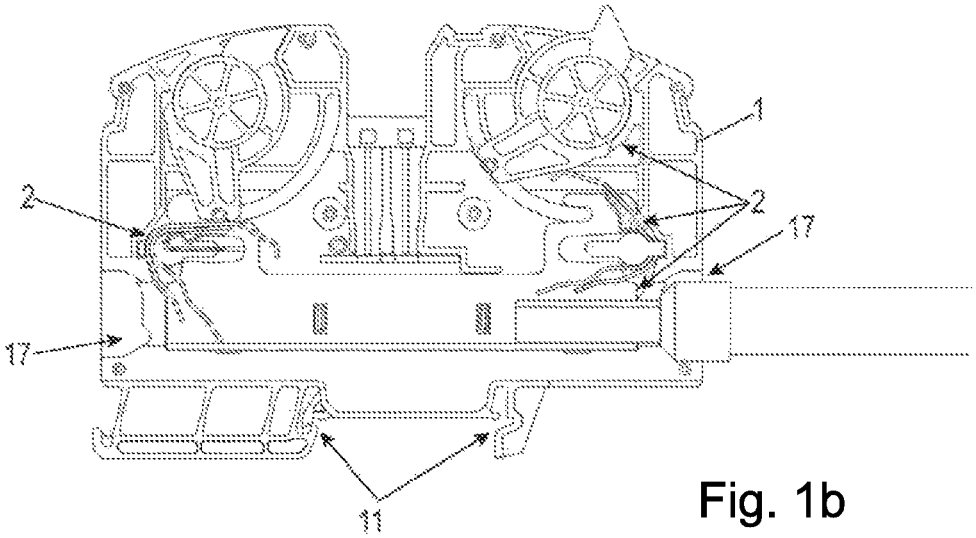
FIGS. 1*b* to 1*e* show the series terminal of FIG. 1*a*, the second connection device in each case being or having been moved, in successive steps, respectively, into a contact position.
Figure 1C:
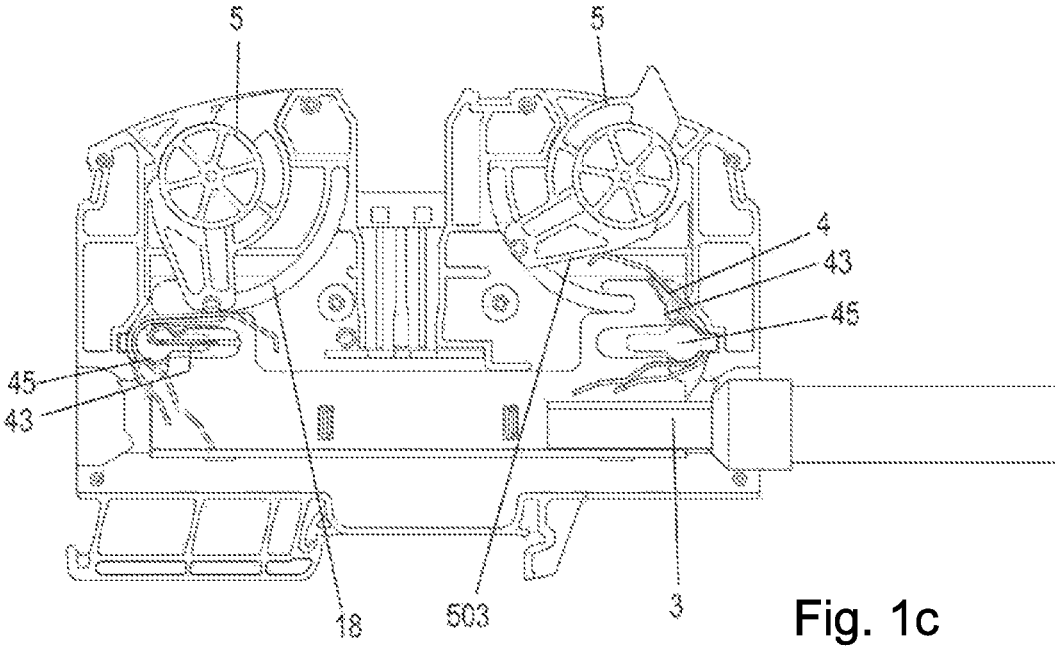
Figure 1D:
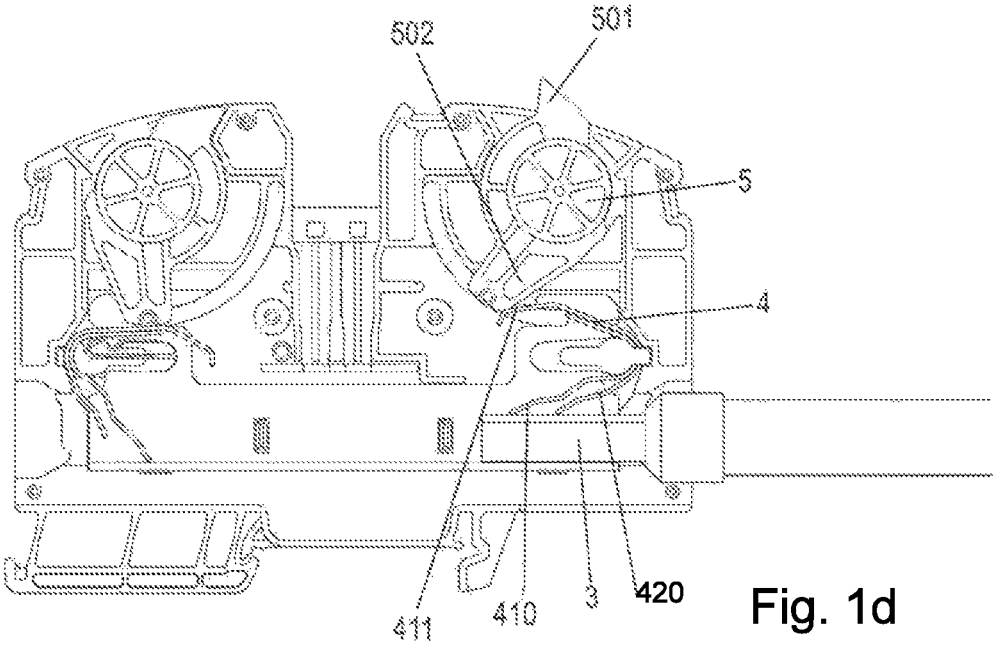

For simplicity, a Cartesian coordinate system X/Z is illustrated in FIG. 1, the direction perpendicular to the plane of the page being designated as the Y-direction. In the following description, the conductor insertion direction is designated as the X-direction.

FIG. 1 shows a housing 1, which in this case is formed as a terminal housing. One or more—in this case two—connection devices 2 for connecting an associated conductor end 3 are arranged in the housing. In FIG. 1, only one conductor end 3 is shown. The conductor ends 3 are portions of conductor wires from which insulation has been removed. The conductor ends may be single wires or multiple or stranded conductors or for example crimped wire ends of a highly electrically conductive material, such as copper.

The housing 1 is formed of electrically insulating material, in particular of a non-conductive plastics material. The housing 1 is formed disc-shaped in this case and is preferably configured to be stackable in the Y-direction perpendicular to the conductor insertion direction. The terms right, left, up and down are based on the portrayal in the drawings, and accordingly change when the housing 1 moves in space.

The housing 1 may have a mounting foot 11. In this case, the foot is formed for placement, in particular latching, on a carrier rail (not shown). The housing 1 further has an upper surface 12 (this being the surface remote from the mounting foot 11) and two plug-in surfaces 13, 14. In an (imaginary) coordinate system, the direction perpendicular to the plane of the drawing is designated as the Y-direction (the carrier rail extending in this direction), the direction perpendicular to the carrier rail (in FIG. 1 the vertically upward direction) as the Z-direction, and the direction perpendicular thereto (leftwards in FIG. 1) as the X-direction. The two conductor ends 3 are movable in and counter to the X-direction. Thus, the conductor insertion direction of the right conductor end 3 into the right connection device 2 is the X-direction and the conductor insertion direction of the left conductor end (not shown) into the left connection device 2 is the −X-direction.

The connection devices 2 may be formed identically or be symmetrical with respect to one another, in other words mirror-symmetrical about the imaginary plane z-z' perpendicular to the plane of the drawing. As a result, two conductor ends 3 can be easily inserted into the housing 1 from opposite sides and can be contacted therein by the associated connection device 2. This is shown in the embodiment of FIGS. 1-3. One, two as shown, or even more of the connection devices may be arranged in a housing, and thus are arranged side-by-side (for example in a multi-part housing 1).

The connection devices 2 each have a clamping spring assembly 4 and a rotary lever assembly 5. In addition, they each have a busbar section 6 against which the associated conductor end can be pressed or pushed by the clamping spring assembly. The clamping spring assembly 4 acts in the manner of a compression spring in each case.

In FIG. 1, the busbar sections 6 are configured in a single piece with one another, in such a way that the two connection devices 2 are conductively connected by in this case a single-piece busbar. In this way, a through-terminal is implemented between the two connection devices without an electrical functional module. The two busbar sections 6 may be formed as separate busbars which are conductively interconnected directly or via at least one electrical or electronic component.

Figure 1E:
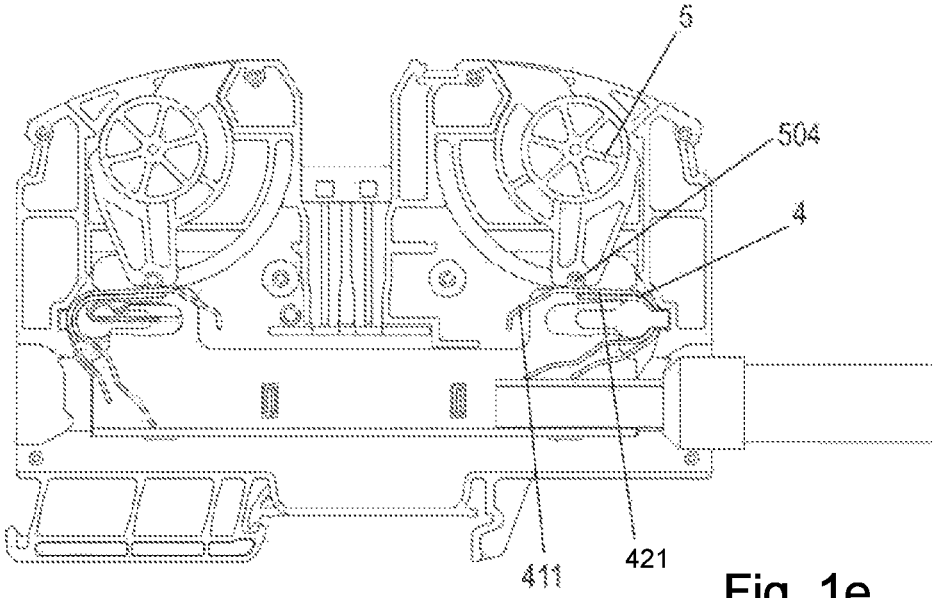
Figure 1F:
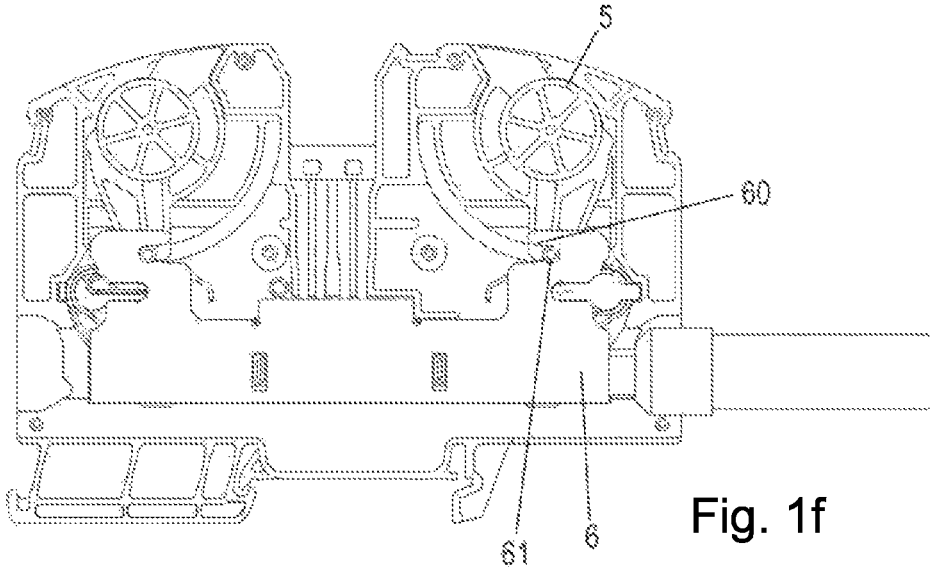
FIG. 1*f* is a side view of the series terminal in the operating position of FIG. 1*e*, without a side wall that is optionally further attached/formed on the side.
Figure 1G:
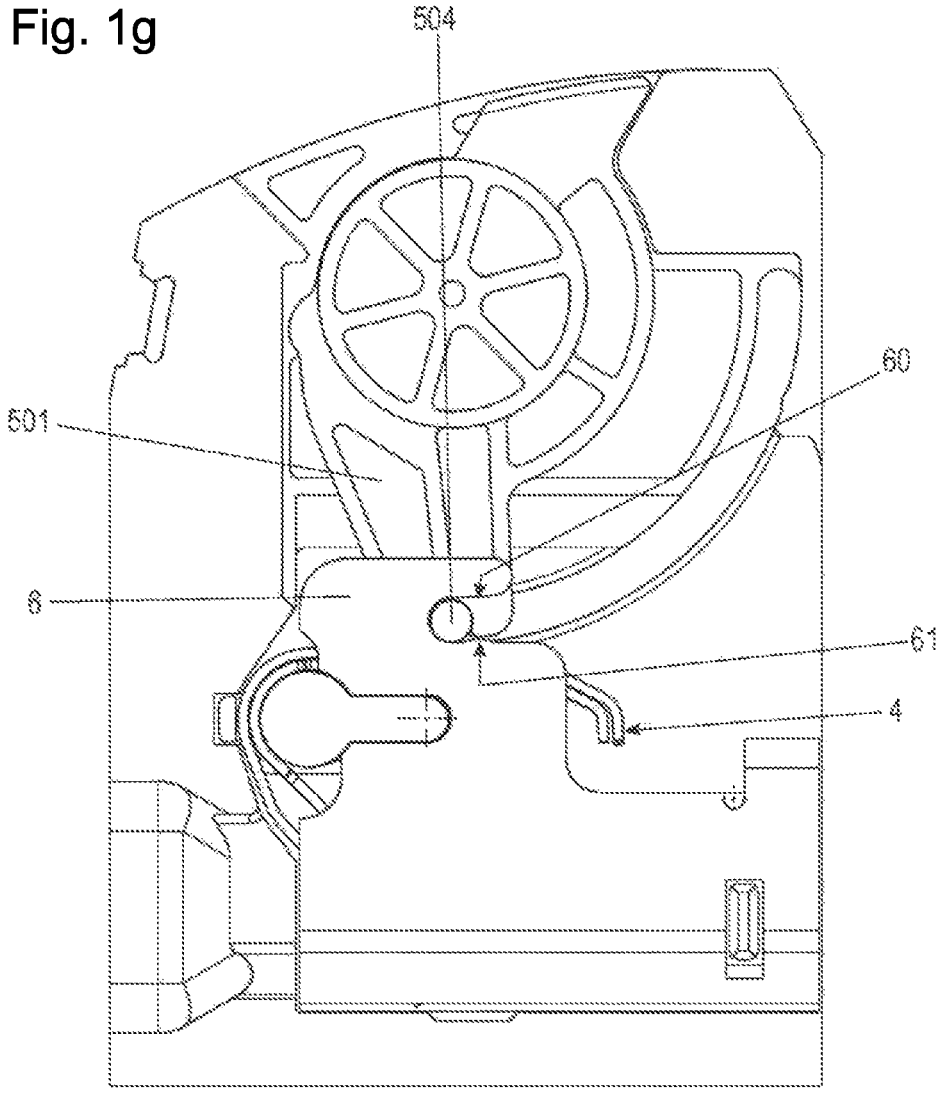
FIG. 1*g* is an enlarged detail of a series terminal formed substantially in accordance with FIG. 1*f;*

The busbar sections 6 preferably have a V or U shape in cross section as shown in FIG. 1*f*. The primary extension direction of the busbar sections 6 is the X-direction perpendicular to the V or U cross section. The associated conductor end 3 is inserted into the connection devices 2 parallel to the primary extension direction (+X, −X) in each case. For this purpose, in the extension of the associated busbar section 6, each housing 1 has an insertion opening 17 for the conductor. The V or U shape may extend over the entire length of the busbar assembly in the primary extension direction or over part of the length.

The clamping spring assembly 4 is designed in such a way that, for introducing the associated conductor end 3, it is pivotable out of the busbar section 6 so that a conductor end 3 is insertable into the associated busbar section 6 through the insertion opening 17. To contact the conductor, the clamping spring assembly 4 as a whole is pivoted towards and partially into the busbar section 6, the conductor end 3 being contacted. The clamping spring assembly 4 finally takes on a fixed position in the contact position and presses the conductor end 3 against the associated busbar section 6 which is made of electrically highly conductive material, in such a way that at least one contact point through which an electric current can flow is formed.

The clamping spring assembly 4 includes one or more clamping springs 41, 42 (shown in FIGS. 2*a* and 3*a*), which are embodied as leaf springs. In FIG. 1, two leaf springs are provided and serve to generate a sufficient contact force. These leaf springs each have at least one clamping limb 410, 420 and at least one actuating limb 411, 421. The at least one clamping limb 410, 420 and the at least one actuating limb 411, 421 are angled, preferably acute-angled at an angle of between 5° and 85° to one another. They are further preferably each interconnected via a bending region 412, 422 or a sort of radius. The bending region 412, 422 is preferably positioned on a spring carrier 45. In FIGS. 2 and 3, the conductor end is not shown so as to better illustrate the rotational movement of the clamping spring assembly 4, which otherwise is influenced by the action of the clamping limb 410, 420 on the conductor end 3. In addition, there is a further leaf spring 43, which is a restoring spring. It is also preassembled and supported on the spring carrier 45, and supported on the clamping springs and can be biased upon movement into the contact position in order to return the clamping springs 41, 42 upon release of the clamping position or after the release thereof.

The spring carrier 45 may be formed in a single piece with the housing 1 or as a separate part from the housing. If it is formed separately from the housing 1, it is advantageous for the clamping spring assembly 4 to be capable of being preassembled on the spring carrier 45, and for the preassembled unit subsequently to be insertable into the housing 1 separately and fixable therein, for example in a positive and/or non-positive fit, in particular by clamping and/or latching. The spring carrier 45 may also be arranged pivotably in the housing. In this case, it may even—if the actuating limb is arranged rotationally engaged thereon—join in with the operation of this actuating limb 410 in whole or in part as shown in FIG. 3. In this case, the carrier forms part of the clamping spring assembly 4. The spring carrier 45 may also be capable of being preassembled on the busbar, preferably respectively in slots 62 of the busbar sections 6.

The clamping springs 41, 42 of the leaf spring assembly are preferably laid inside one another in a stackable manner. This means that the bending regions 412, 422 thereof are positioned inside one another and have exactly or substantially the same axis of rotation D1 or D1'. In this case, the support contour has a rounded journal section 451, about which the clamping springs 41, 42 can be rotated in the bending regions 411, 412 thereof. The spring carrier 45 serves, in the manner of a bolt, in the region in which the bending region 412, 422 is positioned against it, as a pivot bearing for the clamping spring assembly or for the one or more individual springs or clamping springs of the clamping spring assembly 4.

Preferably, the actuating limbs 411, 421 and/or the clamping limbs 410, 420 of the leaf springs 41, 42 are of different lengths. If the actuating limbs 411, 421 are of different lengths, this makes it possible to contact conductor ends 3 of different diameters very well, at positions respectively well-suited thereto, in a simple manner. It is also conceivable to contact a single conductor end 3 using two or more leaf springs at different points.

The clamping spring assembly 4 is preferably orientated in such a way that the bending region 412, 422 is closest to the associated conductor insertion opening 17, so that the clamping limb 410, 420, proceeding from the bending region 412, 422, extends away from the conductor insertion opening 17. The associated clamping limb 410, 420 and the associated actuating limb 411, 421 are thus preferably positioned at an acute angle to the conductor insertion direction (X-direction).

The axes of rotation D1 of the clamping spring assembly 4 and sections of the clamping spring assembly 4 are positioned in the region of the support contour, or the support contour is positioned above the conductor end 3 to be contacted and above the associated busbar section 6 in the Z-direction—in other words in this case perpendicular to the mounting foot or to the carrier rail. The associated rotary lever assembly 5, which has an axis of rotation D2, is further arranged above the clamping spring assembly 4 in the Z-direction. The axis of rotation D2 is positioned above the axis of rotation D1 of the clamping spring assembly in the Z-direction.

Overall, an assembly is produced in such a way that in the housing 1, for each connection device 2, the busbar assembly 6 is arranged below and the open face of the V- or U-shaped cross section thereof is directed towards the associated clamping spring assembly 4, in such a way that the clamping limb or limbs 410, 420 are pivotable into the busbar assembly. In addition, the axis of rotation D2 of the rotary lever assembly 5 is formed and arranged above the clamping spring assembly 4. In this context, the directions of rotation DR of the rotary lever assembly 5 and DR of the clamping spring assembly 4 are in the same direction or orientation. Thus, in the left connection device of FIG. 1 they each rotate clockwise for contacting, and in the right connection device 2 of FIG. 1 they each rotate counter-clockwise for contacting. For release, they are each rotated in the reverse direction.

Figure 2A:
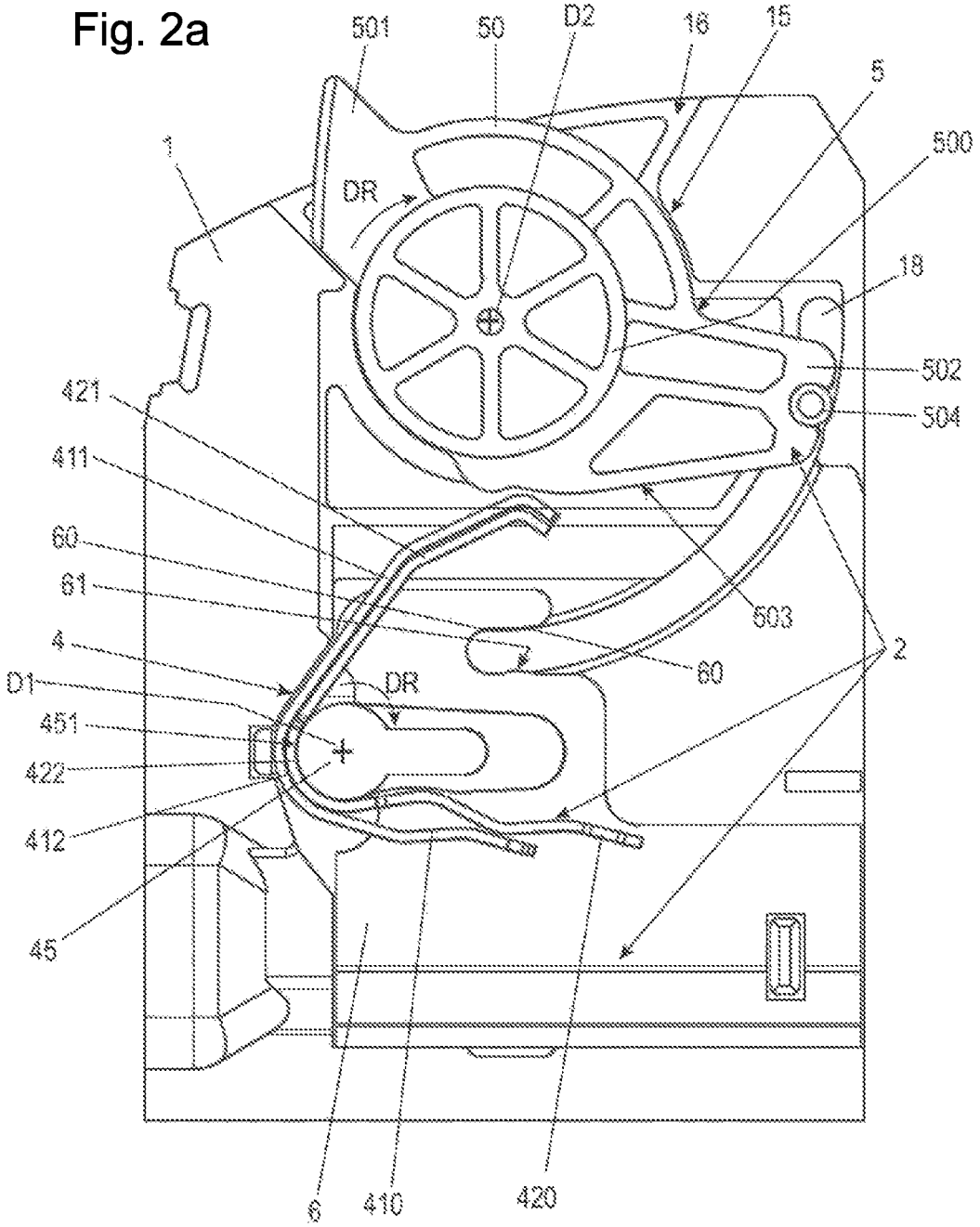
FIGS. 2*a* to 2*f* are portions of the sectional view of FIG. 1*a* with the first connection device in various operating positions, in which it is moved from an open position into a contact position—without a conductor—from FIGS. 1*a* to 1 *e*, respectively.
Figure 2B:
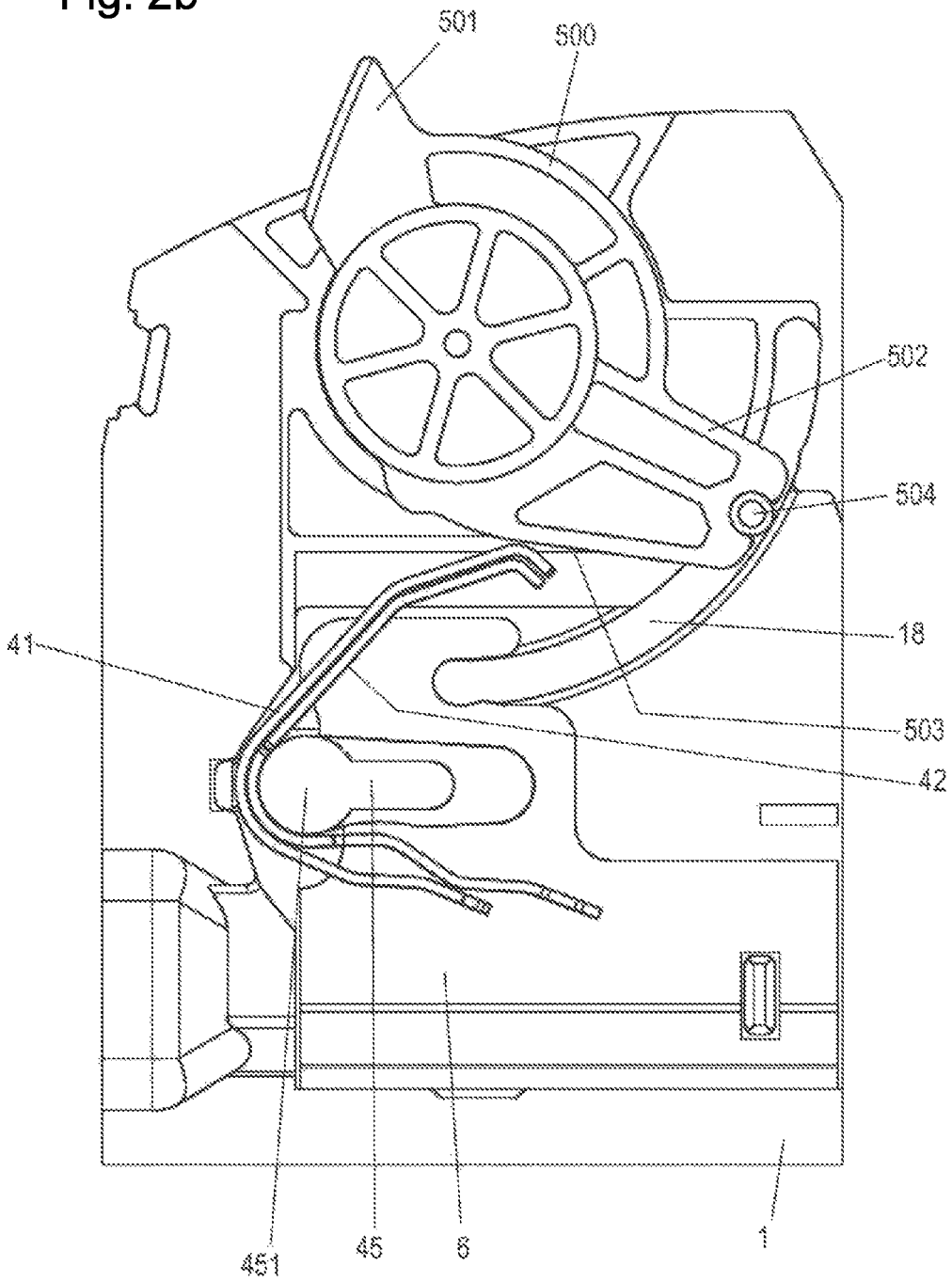
Figure 2C:
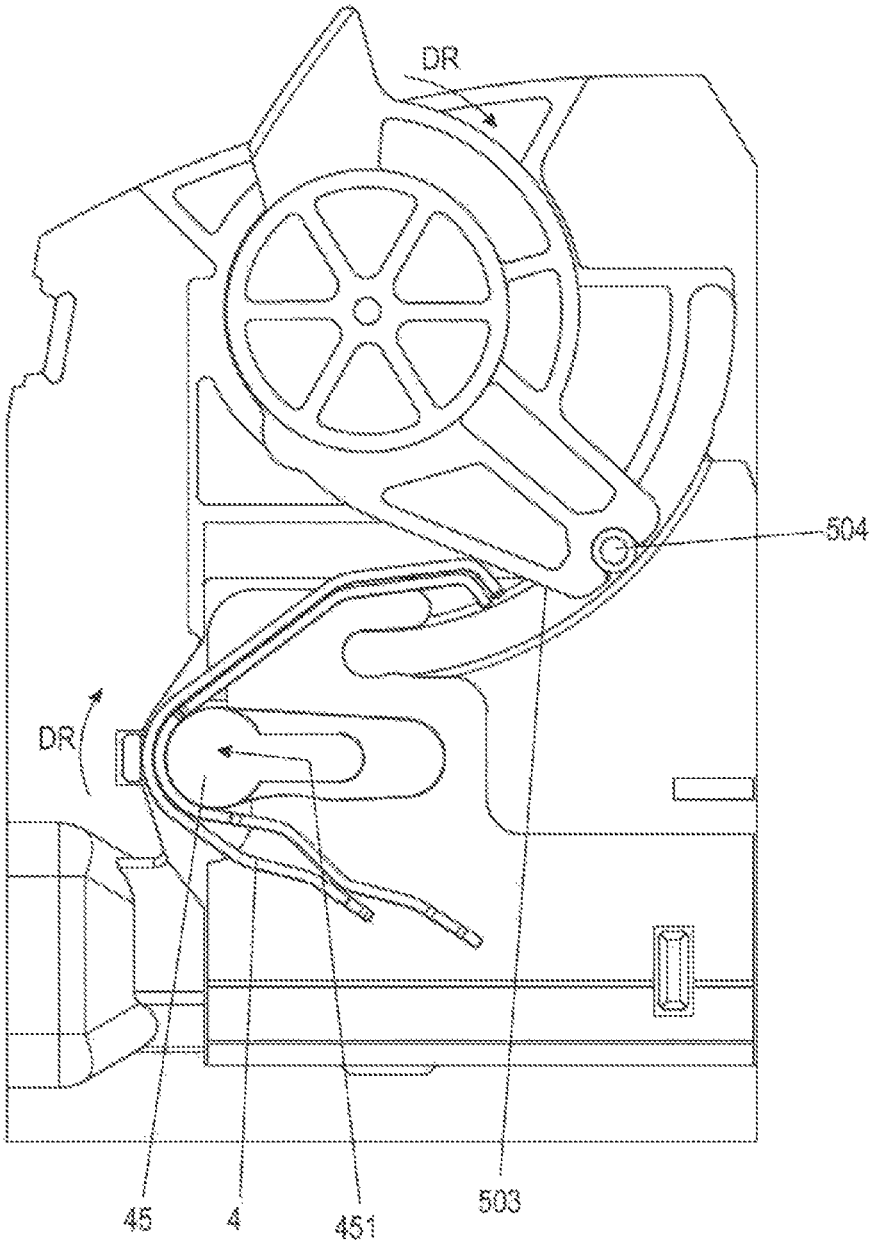
Figure 2D:
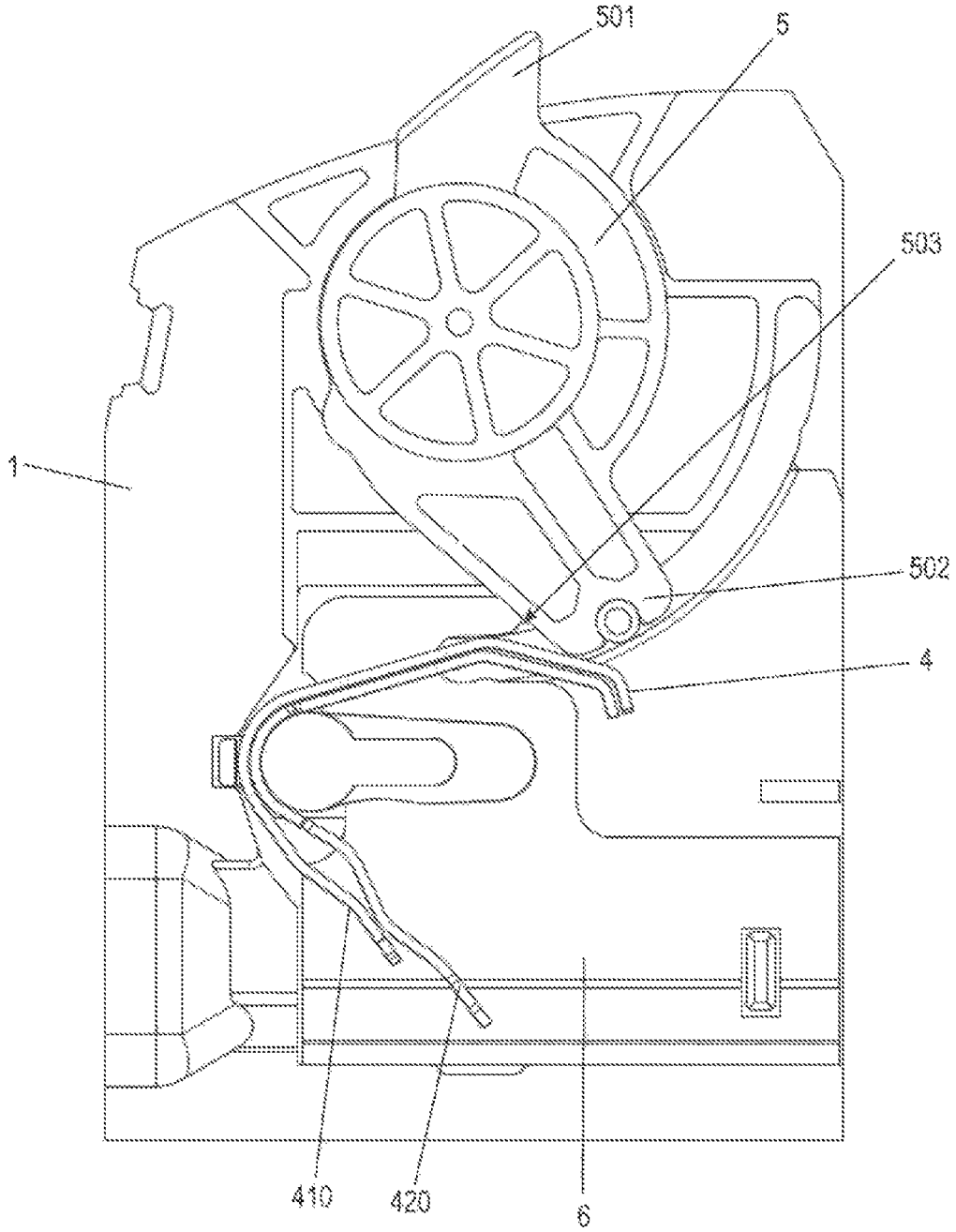
Figure 2E:
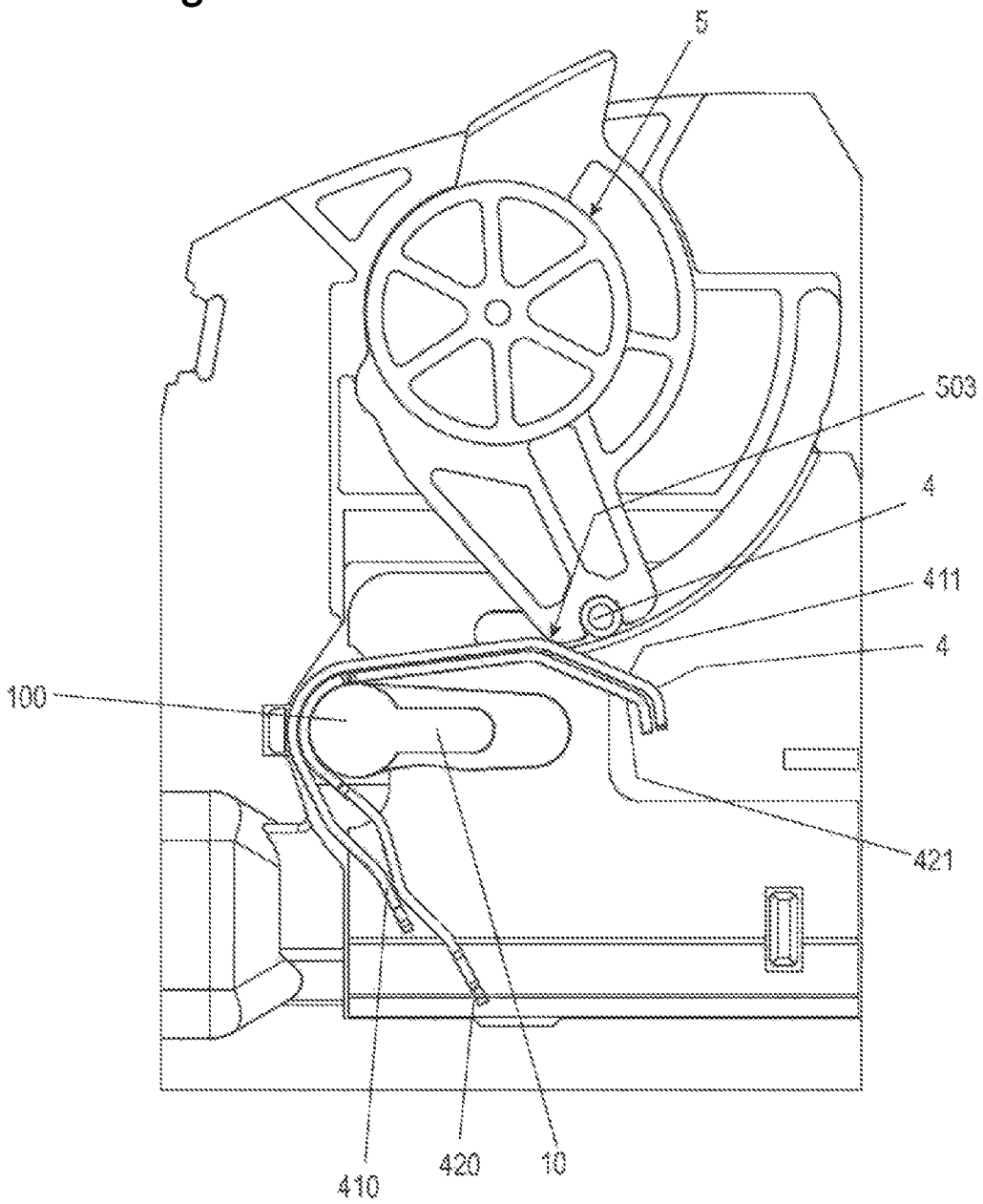
Figure 2F:
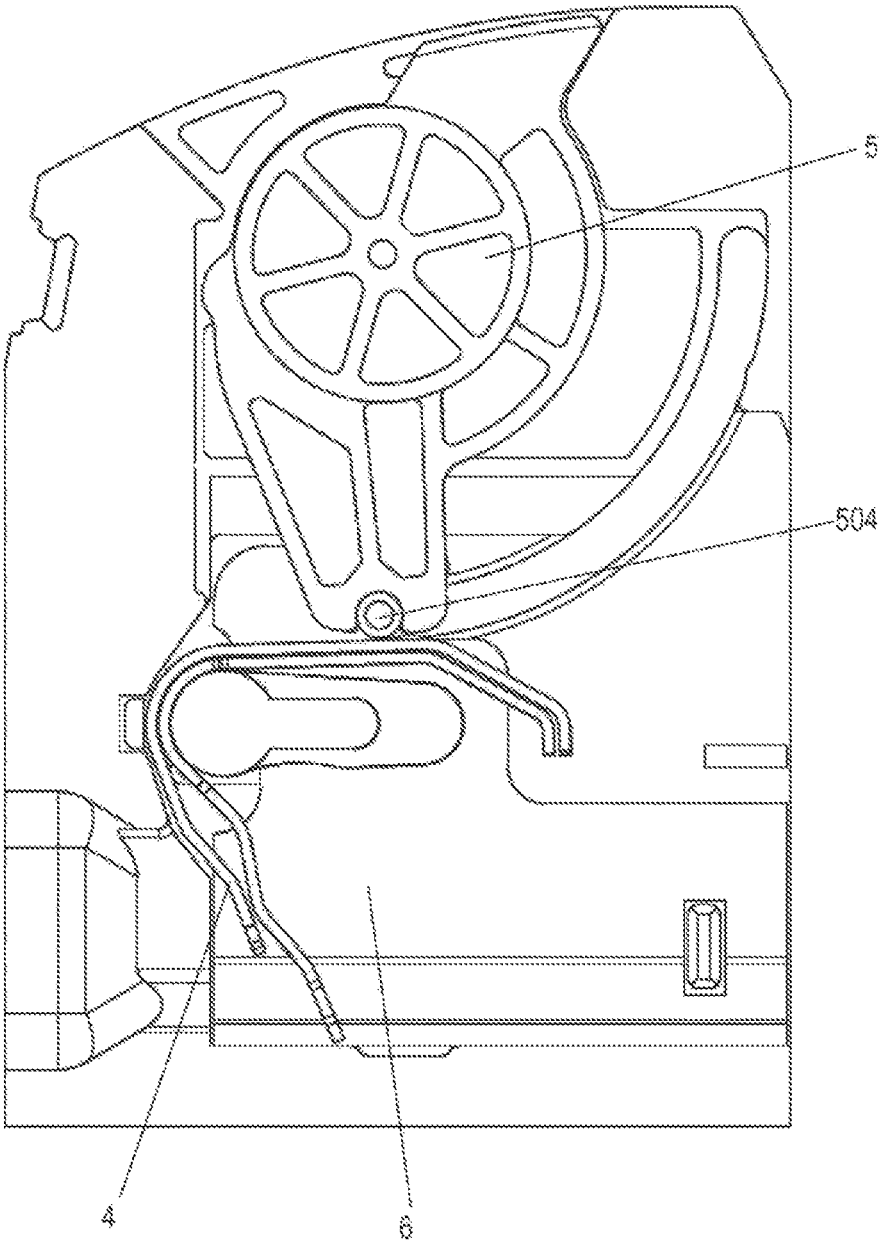
Figure 3A:
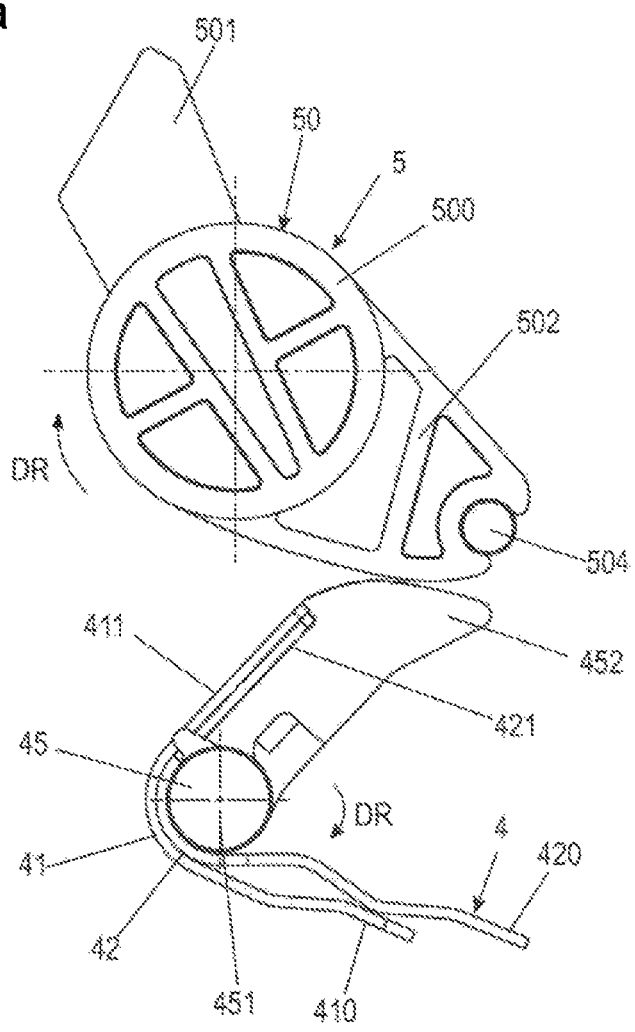
FIGS. 3*a* to 3*d* are enlarged side views which show movable elements of an alternate embodiment of the connection device of FIG. 2 in various operating positions, respectively, in which the connection device is moved from an open position into a contact position—without a conductor—from FIG. 3*a* to FIG. 3*d*.
Figure 3B:
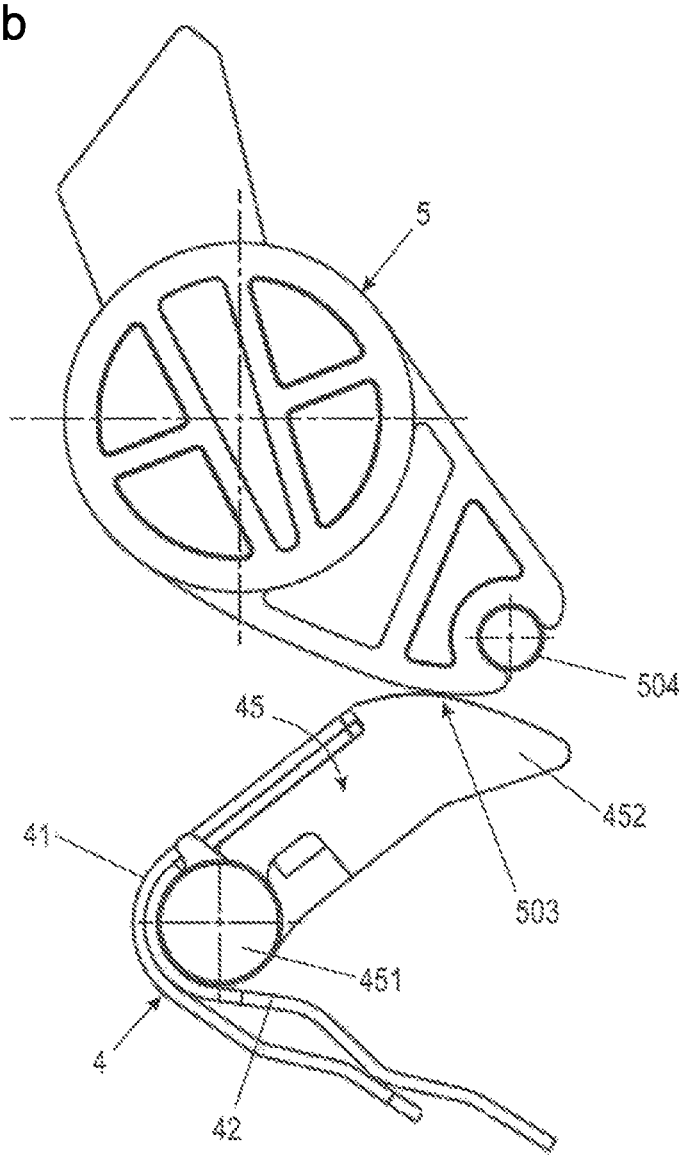
Figure 3C:
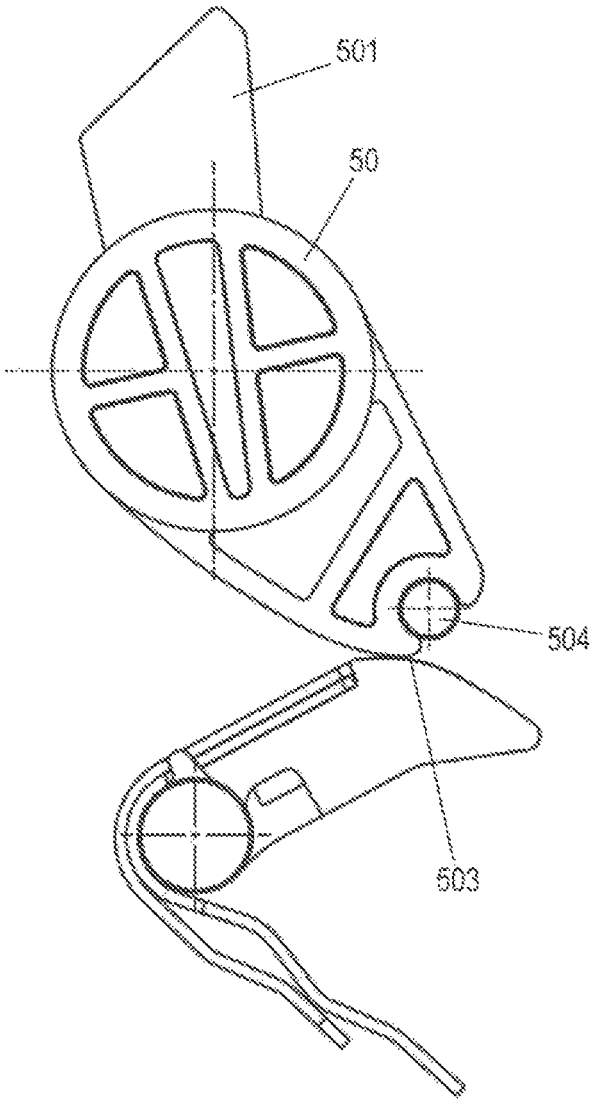
Figure 3D:
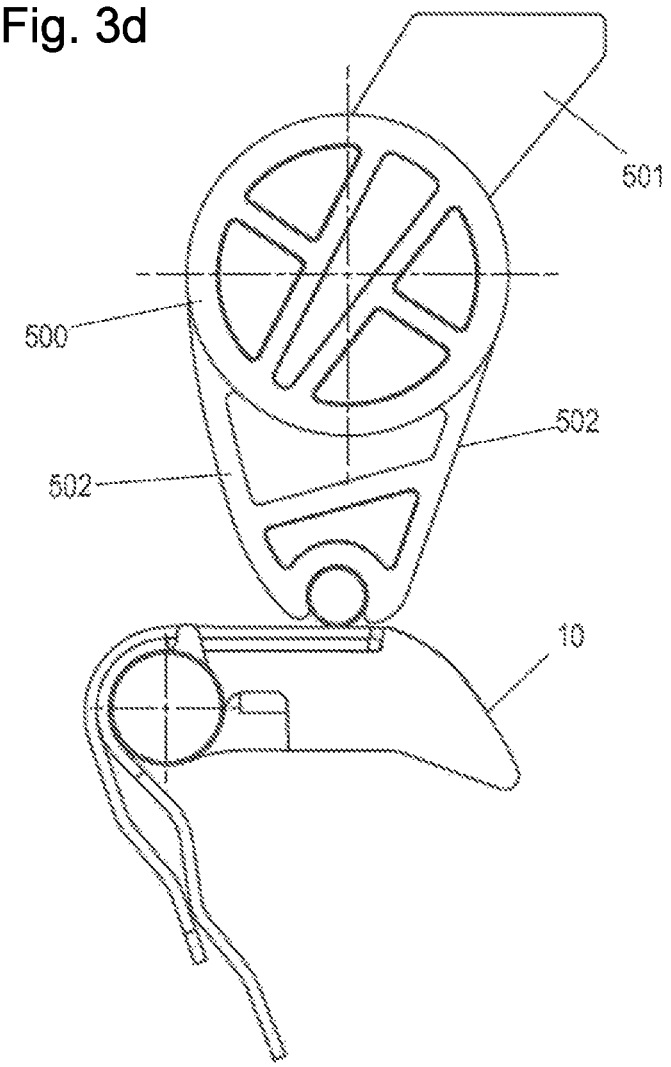

Using the rotary lever assembly 5, the clamping spring assembly 4 can be pivoted from an open position (FIG. 1*a*) (via the plurality of intermediate steps of FIGS. 1*b* to 1*d*, FIGS. 2*a* to 2*e*, and FIGS. 3*a* to 3*e*) into a contact position (FIGS. 1*e*, 2*e*, and 3*d*). The rotary lever assembly 5 has a cam-like configuration. The rotary lever assembly 5 has a preferably disc-like rotary lever element 50, which is mounted rotatably in the housing 1 preferably in or on a central section 500 and has the axis of rotation D2. This can be implemented in various ways. For example, the rotary lever element 50 may be placed on or passed through by a journal in the housing 1, and/or may be inserted into a rotary receiving contour 15 of the housing 1 such as a recess which in any case encloses it in sections on the outer periphery.

The rotary lever element 50 has an actuating section 501, which is preferably accessible from outside the housing 1, in particular at an opening 16 on the upper surface 12 of the housing 1. The actuating section 501 may for example be formed as a shoulder protruding radially from the central section 500 or as an opening, in the region 500, which makes it possible to apply a tool, in particular a screwdriver or the like. The section may also serve as a stop for delimiting the angle of rotation, in and/or counter to the direction of rotation, in cooperation with an opening 16 of the housing from which it projects as shown in FIG. 2*a*.

The rotary lever element 50 further has a cam section 502. In the present case, the cam section 502 is configured as a sort of arm, which extends radially outwards, eccentrically, substantially tangentially, with respect to the central section 500.

The cam section 502 has, on the surface thereof facing the clamping spring assembly 4, a sort of control curve 503, against which the actuating limb or limbs 411, 412 of the clamping springs 41, 42 can be brought to bear.

A projection of the cam section 502 or a pin 504 or the like inserted into the section may engage in a slotted link, in particular an arc-shaped slot in a link 18, of the housing 1 to guide the rotary lever assembly relative to the housing, providing a particularly secure and uniform opening movement.

In the completely open state, the cam section 502 may be positioned on the actuating limbs 411. However, this is not required. Rather, it is also conceivable for the section to be positioned somewhat spaced apart from the clamping spring assembly 4, as shown in FIG. 1*a*, in the completely open position.

The clamping spring assembly 4 may be held—for example using an ancillary spring (not shown)—in the opening position of FIG. 2, or the conductor end 3 of the assembly may be moved into position when the rotary lever assembly 5 is rotated into the opening position thereof, in which the cam section 502 is rotated upwardly away from the busbar section 6.

In the position of FIG. 1*a*, the rotary lever assembly 5 thus releases the clamping spring assembly 4 in such a way that it can be pivoted around by a tool or the conductor in a direction of rotation "-DR", to the left in FIG. 2*a* or FIG. 3*a* or to the right in the right connection device in FIG. 1*a*. As a result, a conductor end 3 can be inserted into the corresponding connection device on the right in FIG. 1*a* or on the left in FIG. 2*a*.

To establish the contact position, the rotary lever assembly 5 is now rotated in a direction of rotation "DR" counter to the direction of rotation "-DR", in such a way that the control curve 503 of the cam section 502 comes to bear against the clamping spring assembly 4 (FIG. 2*b*). Upon further rotation in the direction of rotation DR (FIGS. 1*c*, 1*d*, 2*b*, 2*c*, 3*b*, and 3*c*), the cam section 501 acts like a rotary lever—in the present case like an increasingly long rotary lever—on the actuating limb or limbs 411, 421. In the present case, it acts on the outer actuating limb 411 and presses it downwards in the –Z-direction (in other words, downwardly in the direction of the carrier rail). As a result, the entire clamping spring assembly 4 is rotated in a direction of rotation DR identical to the direction of rotation DR. This presses the clamping limb or limbs 410 harder and harder radially against the conductor end 3 and presses the end against the associated busbar section 6.

It is particularly advantageous that, as a result of the identical directions of rotation, the forces required for actuation are relatively small.

This is apparent from a comparison of FIGS. 1*b* to 1*f* on the right side of the series terminal shown. These drawings show that the point or region at which the cam section 501 touches the clamping spring assembly 4 in each case migrates radially further outwardly on the cam section 501 from figure to figure with increasing closing or pressing of the clamping spring assembly 4 against the conductor. In the present case, this takes place until the pin 504 in the radially outermost region of the cam section 501 is reached by the clamping spring assembly.

In FIG. 1, the end contact position is reached in FIG. 1*f*. In this position, the actuating limbs 411, 421 and/or the rotary lever assembly 5 can additionally be fixed in a positive and/or non-positive fit, for example on the busbar section 6 or on another element, in such a way that a particularly stable end contact position is implemented, which is not released even under relatively high stresses.

The advantages described above were not recognised, or insufficiently recognised, in the prior art, since therein the focus was on other, less important points in the structural implementation. The invention deviates from this, and instead focuses on reliably achieving uniform wiring movement and unwiring movement and achieving a low wiring and unwiring force and achieving a high contact force in the end contact position.

In the following, alternative structural embodiments are described by way of which the invention can be further optimised.

Thus, the actuating limb or limbs 411, 421 may be formed with elbows at the free ends thereof to ensure good sliding of the control curve on the actuating limb or limbs 411, 421.

When the end contact position is reached, the clamping limb or limbs 410, 420 press on the conductor end (FIGS. 1*d* and 1 *e*), preferably until the clamping spring assembly 4 and/or the rotary lever assembly 5 are fixed on a thrust bearing in a positive and/or non-positive fit.

Preferably, a latching device, for example the aforementioned pin 504, is formed on the cam section 502, and is movable into a fixing position in the slotted link 18. This fixing position is formed in the busbar. For this purpose, the slot of link 18 in the housing transitions into a corresponding slot in a link 60 in the associated busbar section 6, or rather ends in this section, before the latching position is reached. The slot of link 60 may have, in the associated busbar section, a constriction point 61 or a top-dead-center point in which the pin 504 is fixed securely in place, in particular latched, when the end contact position is reached. This can be seen particularly clearly in FIG. 1*g*, The slotted link 18 is aligned with the slotted link 60. Specifically, for releasing the end contact position, it is merely necessary to move the pin from the latching position behind the constriction 61 of the slotted link 60 in the busbar by rotating the rotary lever assembly 5.

It is advantageous if the end contact position is durably securely fixed on the metal busbar 6 and not in the plastics material housing 1. In this case, attaching a pin 504 to the cam section and forming the latching position in the slotted link 60 of the busbar section 6 offers a particularly simple embodiment for fixing the spring assembly in the end contact position, which also results in simple, uniform operability when establishing and releasing the contact position. It is also advantageous for release from the end contact position, that no latching hook or the like on the spring assembly has to be released from a locking position.

In FIG. 3, the spring carrier 45 is arranged pivotably in the housing 1. Since in the present case the actuating limb is arranged rotationally engaged on the carrier, it thus joins with the functionality of this actuating limb 411 in whole or in part. This functionality is shown in FIG. 3. In the present case, over part of the rotational movement, the cam section 502 acts on the spring carrier 45 or on an arm 452 of the spring carrier, and additionally rotates the contact spring(s). The clamping limb or limbs are free, and they still function as clamping spring limbs. In the present case, the spring carrier 45 thus also forms part of the clamping spring assembly 4.

Figure 4:
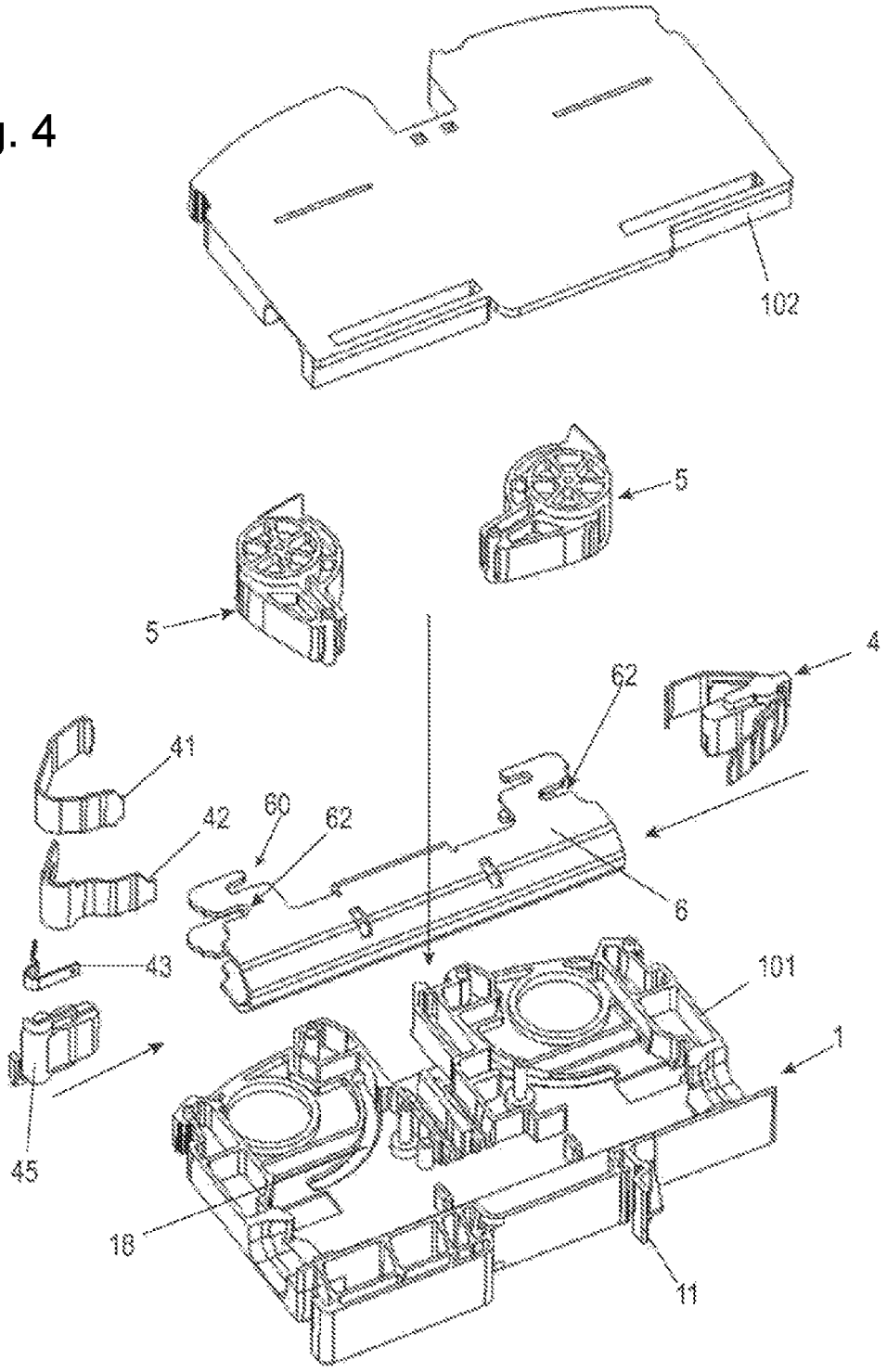
FIG. 4 is an exploded view of the series terminal of FIG. 1.

FIG. 4 illustrates, in an exploded view, the design of a series terminal in the manner of Fig. The disc-like design of the housing 1 in a stackable configuration can dearly be seen. In addition, the disc-like housing 1 may be constructed in a plurality of parts. The housing 1 may for example be composed of two haft-shells 101 and 102, as shown. In one or both of the half-shells 101, 102, the slotted link 18 may be formed which is aligned at one end thereof with the slotted link 60 in the associated busbar section 6. The other half-shell is formed as a rear wall.

The invention claimed is:

1. A connection device for connection of a conductor end, comprising (a) a housing including a link containing a slot;

(b) a busbar arranged in said housing and including a link containing a slot aligned with said slot of said housing link;

(c) a clamping spring assembly rotatably connected with said housing and operable between an open position and a contact position in contact with the conductor end; and (d) a rotary lever assembly including a rotary lever element mounted in a central section of said housing for rotation about an axis to displace said clamping spring assembly from the open position to the contact position, said rotary lever element including a cam section having a control curve surface on which said clamping spring assembly slides during rotation of said rotary lever element for movement into the contact position, said cam section further including a pin which extends into said housing link slot to guide said rotary lever element during rotation relative to said housing, said pin being retained within said aligned housing and bushar link slots in a fixed position corresponding with the contact position.

2. The connection device as defined in claim 1, wherein said busbar link contains a constriction point within said busbar link slot to fix said pin is fixed on said busbar when said clamping spring assembly is in the contact position.

3. The connection device as defined in claim 1, wherein said rotary lever assembly and said clamping spring assembly have the same direction of rotation during rotation from the open position into the contact position.

4. The connection device as defined in claim 1, wherein said busbar has a trough-shaped cross section configuration, the conductor end being insertable into said busbar perpendicular to the busbar cross section, said clamping spring assembly being pivoted into said busbar transverse to the conductor insertion direction to press the conductor end in the contact position into the trough-shaped busbar to contact said busbar.

5. The connection device as defined in claim 1, wherein said clamping spring assembly has an axis of rotation arranged above the conductor end and said rotary lever assembly has an axis of rotation which is arranged above said clamping spring assembly axis of rotation.

6. The connection device as defined in claim 1, wherein said clamping spring assembly comprises at least one leaf spring having at least one clamping limb configured to engage the conductor end and at least one actuating limb.

7. The connection device as defined in claim 6, wherein said rotary lever element cam section control curve surface engages an actuating limb of said leaf spring to move said clamping spring assembly into the contact position.

8. The connection device as defined in claim 7, wherein said rotary lever element further includes an actuating section.

9. The connection device as defined in claim 6, wherein said at least one clamping limb and said at least one actuating limb of said at least one leaf spring are oriented at an acute angle and are connected by a bending region which bears against a spring carrier.

10. The connection device as defined in claim 9, wherein said spring carrier is integral with said housing.

11. The connection device as defined in claim 9, wherein said spring carrier is formed as a separate element from said housing and wherein said clamping spring assembly is preassembled on said spring carrier, said preassembled clamping spring assembly being insertable into the housing with said busbar and clamped to said spring carrier.

12. The connection device as defined in claim 9, wherein said spring carrier is pivotally arranged in said housing.

13. The connection device as defined in claim 9, wherein said rotary lever element cam section engages said spring carrier and rotates it together with said clamping spring assembly.

14. The connection device as defined in claim 9, wherein said spring carrier has a rounded journal section about which said at least one leaf spring is rotated in said bending regions.

15. The connection device as defined in claim 6, wherein said clamping spring assembly comprises two leaf springs laid inside one another and having bending regions positioned inside one another with the same axis of rotation.

16. The connection device as defined in claim 15, wherein said actuating limbs and said clamping limbs of said leaf springs are of different lengths.

17. The connection device as defined in claim 15, wherein said actuating limbs include elbows at the free ends thereof which slide on said control curve.

* * * * *